United States Patent [19]

Fasnacht, Jr. et al.

[11] Patent Number: 4,700,662

[45] Date of Patent: Oct. 20, 1987

[54] SLUDGE LANCE WAND

[75] Inventors: Floyd A. Fasnacht, Jr., Forest; Frank C. Klahn, Huddleston; Bruce W. Schafer; Charles E. Werner, both of Lynchburg, all of Va.

[73] Assignee: The Babcock & Wilcox Company, New Orleans, La.

[21] Appl. No.: 874,257

[22] Filed: Jun. 13, 1986

[51] Int. Cl.[4] ..... F22B 37/52

[52] U.S. Cl. ..... 122/392; 122/382; 239/556; 239/557

[58] Field of Search ..... 122/379, 381, 382, 390, 122/391, 392; 239/550, 554, 600, 553.3, 557, 565; 15/316 R

[56] References Cited

U.S. PATENT DOCUMENTS

| | | | |
|---|---|---|---|
| 909,711 | 2/1909 | Thompson | 239/550 |
| 975,328 | 11/1910 | Clark | 122/381 X |
| 4,424,769 | 1/1984 | Charamathieu et al. | 122/392 |
| 4,526,135 | 7/1985 | Calhoun et al. | 122/382 |

*Primary Examiner*—Edward G. Favors

*Attorney, Agent, or Firm*—Robert J. Edwards; D. Neil LaHaye

[57] ABSTRACT

A sludge lance wand for cleaning once through steam generator tubes. A curved high pressure fluid feed tube has a plurality of feed tube extensions attached at one end and a first nozzle brace attached at the other end and in fluid communication with the feed tube. A second nozzle brace bolted to the first nozzle brace retains nozzle blocks in position between the two braces. The nozzle blocks are in fluid communication with the first nozzle brace and are provided with nozzle openings angled for cleaning the triangular-pitch positioned tubes in a once through steam generator. O-ring seals on each end of the nozzle blocks press fit against the braces to prevent leakage and insure that full fluid flow is directed through the nozzle openings.

12 Claims, 3 Drawing Figures

SLUDGE LANCE WAND

BACKGROUND OF THE INVENTION

1. Field of the Invention

The present invention relates to equipment for cleaning steam generators and in particular to a high pressure fluid lance for cleaning sludge off the steam generator tubes near the lower tubesheet.

2. General Background

In nuclear power stations, steam generators such as recirculating steam generators (RSG's) and once-through steam generators (OTSG's) are used for heat exchange purposes in the generation of steam for driving turbines. Primary fluid which is heated by the core of the nuclear reactor is led through a collection or bundle of tubes in the steam generator. A secondary fluid, generally water, which is fed into the space around the tubes receives heat from the tubes and is converted to steam for driving the turbines. After cooling and condensation, the secondary fluid is directed back into the space around the tubes to provide a continuous steam generation cycle. Due to the constant high temperature and severe operating environment, a sludge mainly comprised of an iron oxide such as magnetite builds up on the lower outer portion of the tubes and on the tubesheet which supports the tube handle. As the sludge buildup on the tube bundle reduces the heat transfer efficiency of the tubes and can cause corrosion, it is preferable that the tubes be periodically cleaned to remove the sludge. Cleaning methods which applicants are aware of include the following.

U.S. Pat. No. 4,566,406 entitled "Sludge Removing Apparatus For A Steam Generator" discloses a manifold which is rigidly attached to the tubesheet and remains in place during conventional operation of the steam generator. A plurality of nozzles on the manifold emit streams of water to break up sludge on the upper surface of the tubesheet and openings provided in the walls of the steam generator are used to remove the slurry.

U.S. Pat. No. 4,422,882 entitled "Pulsed Liquid Jet-Type Cleaning Of Highly Heated Surfaces" discloses a method and apparatus for removing deposits from the fire sides of the tubes of boilers while steaming by employing a sootblower to project a moving pulsed jet of liquid against the deposits. The peak impact pressure of the jet is increased by pulsing means such as a fluidic or rotary type.

U.S. Pat. No. 4,079,701 entitled "Steam Generator Sludge Removal System" discloses an arrangement of headers at the elevation of the sludge to be removed for establishing a circumferential fluid stream at that elevation. A fluid lance moved along the line between the headers emits a fluid jet perpendicular to the line of movement of the fluid lance. The fluid lance may also be rotated as it is moved. This system is indicated for use in RSG's.

In OTSG's, a cleaning method also used is that of feeding water in the generator at the top and suctioning out at the bottom in an attempt to loosen and remove the sludge.

A problem encountered in many OTSG's is that access ports, known as handholes in the art, to the tube bundle and tubesheet are normally provided at a level above the tubesheet. This makes it difficult or impossible with existing equipment to reach and clean the tube bundle at the tubesheets in steam generators which have not been designed or retro fitted with special cleaning equipment.

SUMMARY OF THE INVENTION

The present invention solves the aforementioned problem in a straightforward manner. What is provided is a high pressure fluid feed tube, a plurality of nozzle blocks that receive fluid from the feed tube, and a pair of nozzle braces which secure the nozzle blocks in position and help prevent vibration during operation. One of the nozzle braces is provided with a lower projection or platform which rests on the lower tube sheet.

BRIEF DESCRIPTION OF THE DRAWINGS

For a further understanding of the nature and objects of the invention, reference should be had to the following description taken in conjunction with the accompanying drawings in which like parts are given like reference numerals and, wherein.

DETAILED DESCRIPTION OF THE PREFERRED EMBODIMENT

Figure 1:
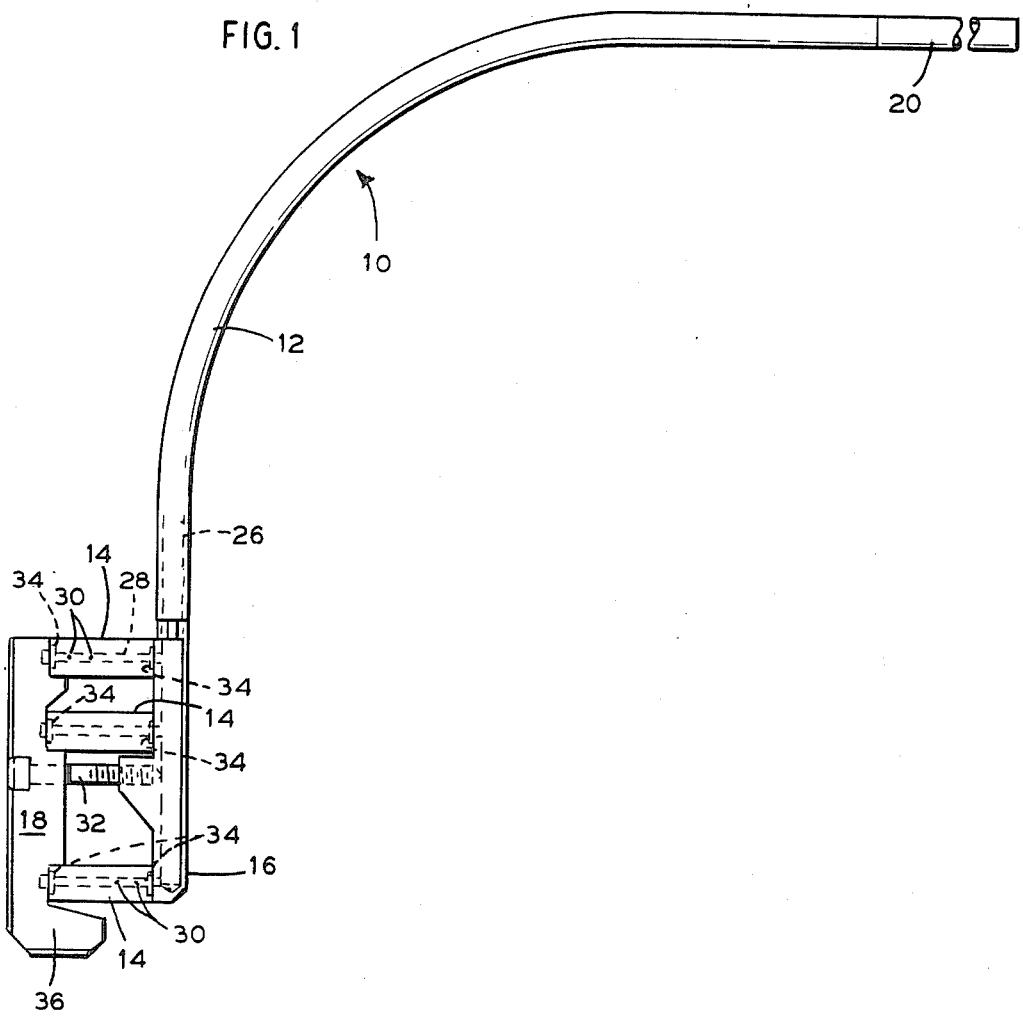
FIG. 1 is a side view of the invention.

Referring now to the drawings, it is seen that the apparatus is generally referred to by the numeral 10. As best seen in FIG. 1, lance wand 10 is generally comprised of high pressure fluid feed tube 12, a plurality of nozzle blocks 14, nozzle braces 16, 18, and a plurality of feed tube extensions 20 (only one of which is shown).

Feed tube 12 is preferably rigid and curved as illustrated in FIG. 1. The curve of feed tube 12 allows insertion into the steam generator through handhole 22, illustrated in FIG. 3, and provides access to the lower part of the tubes in tube bundle 24 adjacent the tubesheet. Feed tube 12 is hollow to provide fluid passageway 26 illustrated in phantom view in FIG. 1. A plurality of feed tube extensions 20, only one of which is shown, are attached to one end of fluid feed tube 12 to serve as a means for manipulating lance wand 10 during operation and supplying fluid thereto.

A first nozzle brace 16 is attached to the other end of fluid feed tube 12 so as to be in fluid communication therewith. Fluid received by first nozzle brace 16 is directed via the fluid passageway therein to nozzle blocks 14.

Figure 2:
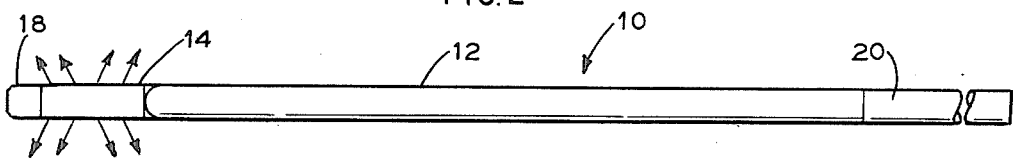
FIG. 2 is a top view of the invention.

Nozzle blocks 14 are square in cross section in the preferred embodiment but may be formed into any shape suitable for the operation to be performed. Nozzle blocks 14 are in fluid communication with first nozzle brace 16 and fluid feed tube 12 and receive fluid from first nozzle brace 16 in nozzle fluid passage 28, illustrated in phantom view in FIG. 1. The high pressure fluid received by nozzle blocks 14 is released through nozzle openings 30. Nozzle openings 30 may consist of holes drilled into nozzle blocks 14 and nozzle passages 28 or may be specialized nozzles adapted to fit nozzle blocks 14. Nozzle openings 30 are angled to provide directional flow (as indicated by the arrows in FIGS. 2 and 3) for specified cleaning operations such as the triangular pitch tube arrangement in a once through steam generator. Nozzle fluid passages 28 extend longitudinally through nozzle blocks 14. Nozzle blocks 14 are held in position against first nozzle brace 16 by second nozzle brace 18.

Second nozzle brace 18 is solid and attached to first nozzle brace 16 by bolt 32. Nozzle blocks 14 are retained in their installed position between first and second braces 16, 18 by pressure from bolt 32. To insure that the fluid supplied to nozzle blocks 14 exits only through nozzle openings 30, nozzle blocks 14 are provided with O-ring seals 34. The pressure against O-ring seals 34 creates a fluid seal which prevents leakage during operation but also allows easy disassembly for replacement or change of nozzle blocks 14. Second nozzle brace 18 is also provided with means for supporting the assembly on the lower tubesheet during operation. Support foot 36 extends from the lower end of second nozzle brace 18 and is allowed to move along the surface of the tubesheet during operation. This provides a steady platform for sludge lance wand 10 and positions nozzle blocks 14 at the desired height.

Figure 3:
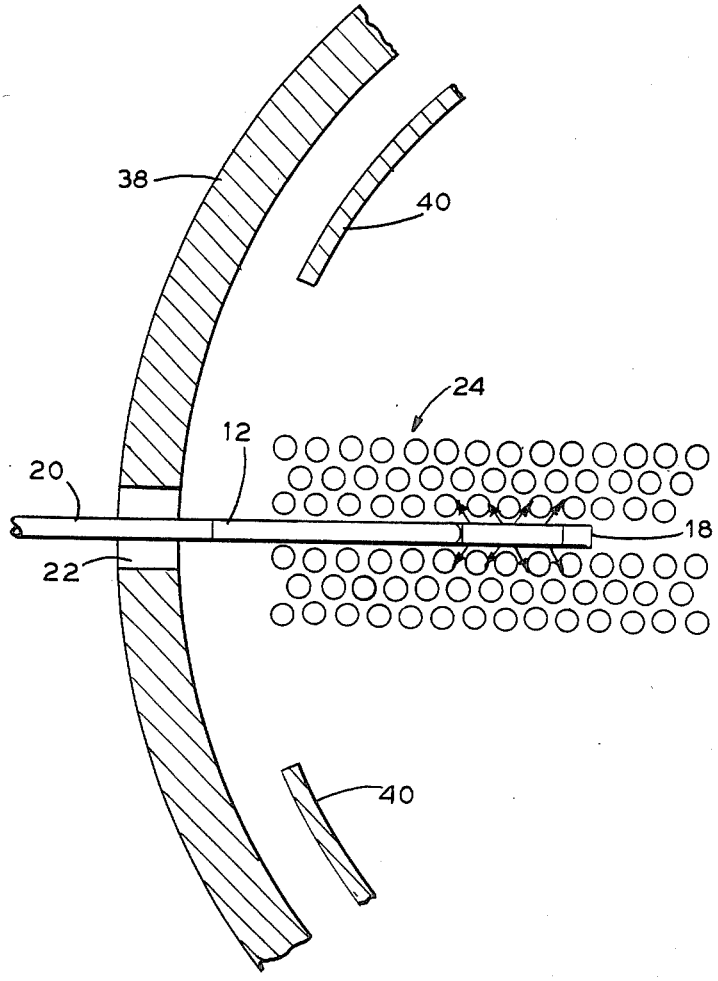
FIG. 3 is a top view of the invention when in use in a steam generator.

In operation, sludge lance wand 10 is inserted into steam generator shell 38 and into a lane or space between tubes in tube bundle 24. As seen in FIG. 3, a space provided in shroud 40 around tube bundle 24 allows easy access thereto. Support foot 36 is positioned on the lower tube sheet and fluid pressure is supplied from a fluid source not shown. As indicated by the arrows in FIG. 3, fluid exits nozzle openings 30 at angles specifically set for the arrangement of tubes in the tube bundle being cleaned. As the assembly is moved through the tube bundle the fluid flow loosens and removes sludge from the tubes which is then removed from the generator by a suction system. The fluid/-sludge mixture is filtered to remove the solids and the fluid is then recirculated. The nozzle blocks are easily replaced or changed so that different sizes or configurations can be used. Manipulation of the assembly during operation may be done manually or remotely while being monitored by a video system.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A sludge lance wand, comprising:

a. a high pressure fluid feed tube;

b. a first nozzle brace attached to one end of said fluid feed tube and in fluid communication therewith;

c. a second nozzle brace attached to said first nozzle brace; and d. a plurality of nozzle blocks positioned between said first and second nozzle braces and in fluid communication with said first nozzle brace.

2. The apparatus of claim 1, wherein said high pressure fluid feed tube is curved.

3. The apparatus of claim 1, further comprising a plurality of feed tube extensions attached to the other end of said high pressure fluid feed tube.

4. The apparatus of claim 1, further comprising O-ring seals between said nozzle blocks and said first and second nozzle braces.

5. The apparatus of claim 1, wherein said nozzle blocks are provided with nozzle openings adapted for cleaning the tubes in a once steam generator.

6. The apparatus of claim 1, further comprising a support foot at the lower end of said second nozzle brace.

7. A sludge lance wand, comprising:

a. a curved high pressure fluid feed tube;

b. a first nozzle brace attached to the end of said fluid feed tube and in fluid communication therewith;

c. a second nozzle brace attached to said first nozzle brace;

d. a plurality of nozzle blocks positioned between said first and second nozzle braces and in fluid communication with said first nozzle brace; and e. a plurality of feed tube extensions attached to the other end of said fluid feed tube.

8. The apparatus of claim 7, further comprising O-ring seals between said nozzle blocks and said first and second nozzle braces.

9. The apparatus of claim 7, wherein said nozzle blocks are provided with nozzle openings adapted for cleaning the tubes in a once through steam generator.

10. The apparatus of claim 7, further comprising a support foot at the lower end of said second nozzle brace.

11. A sludge lance wand, comprising:

a. a curved high pressure fluid feed tube;

b. a first nozzle brace attached to one end of said fluid feed tube and in fluid communication therewith;

c. a second nozzle brace having a support foot at its lower end and attached to said first nozzle brace;

d. a plurality of nozzle blocks positioned between said first and second nozzle braces and in fluid communication with said first nozzle brace and having nozzle openings adapted for cleaning the tubes in a once through steam generator; and e. a plurality of feed tube extensions attached to the other end of said fluid feed tube.

12. The apparatus of claim 11, further comprising O-ring seals between said nozzle blocks and said first and second nozzle braces.

* * * * *